US005380108A

United States Patent [19]

Fukahori et al.

[11] Patent Number: 5,380,108

[45] Date of Patent: Jan. 10, 1995

[54] MULTI-PASS THERMAL PRINTER

[75] Inventors: Kenichi Fukahori; Shuji Sato; Masaki Shimoha; Hideki Ito, all of Kanagawa; Shin Iima, Tokyo; Mutsuko Narita, Kanagawa, all of Japan

[73] Assignee: Sony Corporation, Japan

[21] Appl. No.: 957,088

[22] Filed: Oct. 6, 1992

[30] Foreign Application Priority Data

Oct. 24, 1991 [JP] Japan ..... 3-275897

[51] Int. Cl.[6] ..... B41J 35/36

[52] U.S. Cl. ..... 400/247; 400/703; 400/649; 242/348

[58] Field of Search ..... 400/120, 120 MC, 120 MP, 400/120 HE, 247, 248, 248.1, 248.2, 249, 250, 649, 692, 703, 708, 711, 234; 242/57

[56] References Cited

U.S. PATENT DOCUMENTS

| | | | |
|---|---|---|---|
| 4,532,525 | 7/1985 | Takahashi | 346/76 |
| 4,549,485 | 10/1985 | Nawrath | 101/219 |
| 4,828,408 | 5/1989 | Bekker-Madsen et al. | 400/120 |
| 5,032,032 | 7/1991 | Chu et al. | 400/234 |
| 5,051,009 | 9/1991 | Sugiura et al. | 400/120 |
| 5,118,208 | 6/1992 | Kitahara et al. | 400/120 |

FOREIGN PATENT DOCUMENTS

| | | | |
|---|---|---|---|
| 0386919 | 9/1990 | European Pat. Off. . | |
| 0387699 | 9/1990 | European Pat. Off. . | |
| 0522904 | 1/1993 | European Pat. Off. . | |
| 3420335 | 12/1984 | Germany . | |
| 3739508 | 6/1989 | Germany . | |
| 132354 | 11/1978 | Japan | 400/120 HE |
| 67278 | 6/1981 | Japan | 400/120 |
| 151585 | 11/1981 | Japan | 400/249 |
| 210871 | 12/1982 | Japan | 400/249 |
| 45180 | 3/1984 | Japan | 400/120 HE |
| 64369 | 4/1984 | Japan | 400/120 |
| 220772 | 11/1985 | Japan | 400/120 HE |
| 250974 | 12/1985 | Japan | 400/120 MP |
| 62-45145 | 3/1987 | Japan . | |
| 113583 | 5/1987 | Japan | 400/249 |
| 297267 | 11/1989 | Japan | 400/120 MP |
| 2100673 | 1/1983 | United Kingdom . | |

OTHER PUBLICATIONS

Patent Abstracts of Japan, vol. 13, No. 033 (M-789) 25 Jan. 1989 and JP-A-63 242 669 (Fujitsu General Ltd.), 7 Oct. 1988.

Patent Abstracts of Japan, vol. 9, No. 139 (M-387) (1862), 14 Jun. 1985 and JP-A-60 018 374 (Fuji Xerox K.K.), 30 Jan. 1985.

R. M. De Loof et al; "Automatic Loading & Unloading . . . "; *IBM Tech Disc Bull.*; vol. 6, No. 10, Mar. 1964 pp. 13-14.

*Primary Examiner*—David A. Wiecking

*Attorney, Agent, or Firm*—Ronald P. Kananen

[57] ABSTRACT

A thermal printer accepting an ink ribbon cartridge includes a chassis, a thermal head secured to the chassis and a platen roller which is rotatably supported in the chassis and swingably movable relative to the thermal head. The platen roller is rotated by a first platen driving mechanism and is moved toward and away from the thermal head by a second platen driving mechanism. When the platen roller is moved to contact the thermal head via an ink ribbon intervened therebetween, an image is printed on a printing medium fed between the platen roller and the ink ribbon. The printer accomplished aligned overprinting on the printing medium via a paper supply mode, a printing mode, a paper retract mode and a paper discharge mode effected by the first and second platen driving mechanisms.

13 Claims, 16 Drawing Sheets

MULTI-PASS THERMAL PRINTER

BACKGROUND OF THE INVENTION

1. Field of the Invention

The present invention relates generally to a thermal printing apparatus. Particularly, the invention relates to a printer which prints different parts of an image over a previously printed part such as in a four color printing process or the like. Specifically, the present invention relates to a color video printer.

2. Description of the Prior Art

Thermal head type printers are well known in the art in which a thermal head is pressed against a sheet of material supported on platen roller for printing an image on the material. In order to release heat generated by energization of the thermal head, a radiator, or heat radiating fin is provided on a rear portion of the thermal head. Generally, the thermal head is mounted on a shaft so as to be enabled to move in and out of contact with the platen roller. Upon printing, the thermal head is sufficiently heated so that an image is printed on the sheet. Heat generated in the thermal head is radiated by the heat radiating fin within a housing of the apparatus. An example of such a printing apparatus, is disclosed in Japanese Utility Model application (First Publication) No. 62-45145.

However, such a know printing apparatus employs a motor-driven cooling fan or the like in order to exhaust air heated by heat radiation from the printer housing. Therefore, the apparatus must be of a size for accommodating such a fan and manufacturing costs and complexity become increased. Further, the above type of printer requires a two reel type ink arrangement for positioning of an ink cartridge, further increasing size of the printer.

SUMMARY OF THE INVENTION

It is therefore a principal object of the present invention to overcome the drawbacks of the prior art.

It is a further objection of the invention to provide a printer which has efficient heat discharge characteristic and which operates with high reliability.

It is also an object of the present invention to provide a video printer which is compact in size and which may be made thinner, and more lightweight while reducing manufacturing costs.

In order to accomplish the aforementioned and other objects, a printer is provided, comprising: a housing, a chassis forming a base for the housing, a thermal head fixedly mounted in the housing, a platen roller rotatably supported in the chassis and being movable relative to the thermal head, first platen driving means swingably movable of the platen to second third and fourth orientations relative the thermal head, second platen driving means driving the plate to rotate in clockwise an counterclockwise directions association with movement of the first platen driving means a receptacle for receiving an ink ribbon cartridge containing and ink ribbon, extracting means, extracting the ink ribbon from the ink ribbon cartridge, ink ribbon guide means guiding the ink ribbon extracted by the extracting means around the platen so as to be between the platen and the thermal head, take-up means for retaining ink ribbon as ink ribbon is extracted from the ink ribbon cartridge according to printing and chucking operation by the printer, control means for controlling operation of the first and second platen driving means, the ink ribbon guide means and the take-up means for effecting printing operation on a sheet printing medium such that aligned overprinting is accomplished on the printing medium according to movement of the printing medium via the first through fourth positions of the first platen driving means in conjunction with rotation by the second platen driving means the aligned overprinting comprising at least a first printing operation corresponding to one extracted position of the ink ribbon cartridge and a second printing operation on the printing medium in alignment with the first printing operation and corresponding to another extracted position of the ink ribbon cartridge, the first platen driving means effecting separation between the printing medium and the thermal head between the first and the second printing operations.

DESCRIPTION OF THE PREFERRED EMBODIMENT

Figure 1:
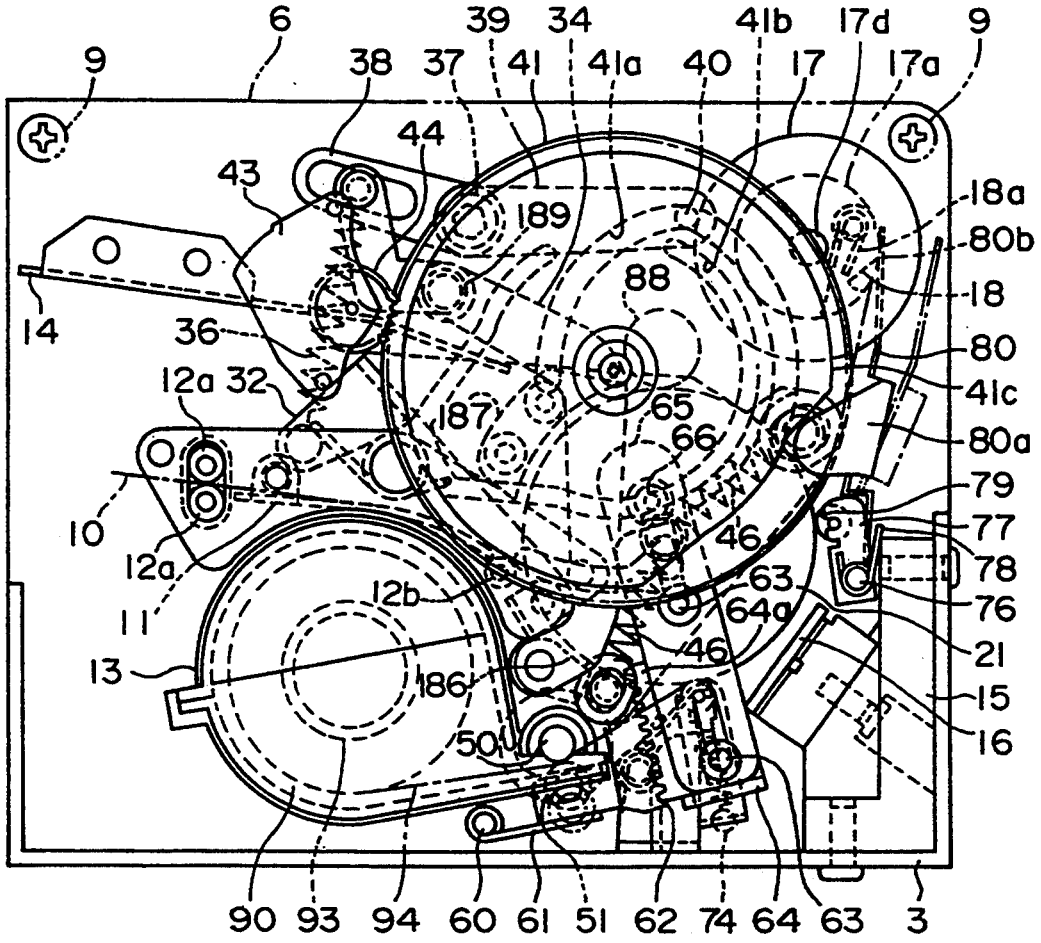
FIG. 1 is a right side view of a preferred embodiment of a color thermal printing apparatus according to the invention.

Referring now to the drawings, particularly to FIG. 1, a thermal transfer type color video printer 1 according to the invention, is shown. The color video printer 1 includes a rectangular casing 2, left and right side plates 4 and 6 disposed at opposite ends of the casing 2, and a channel-shaped main chassis 3 connected at opposite ends thereof to the left and right side plates 4 and 6. The main chassis 3 has a bottom wall and front and rear walls oppositely and upwardly extending from the bottom wall. Between the front and rear walls of the chassis 3, the left and right side plates 4 and 6 are extended. Supporting bars 7 and 8 are disposed between the left and right side plates 4 and 6 and fastened thereto by screws 9.

Figure 21:
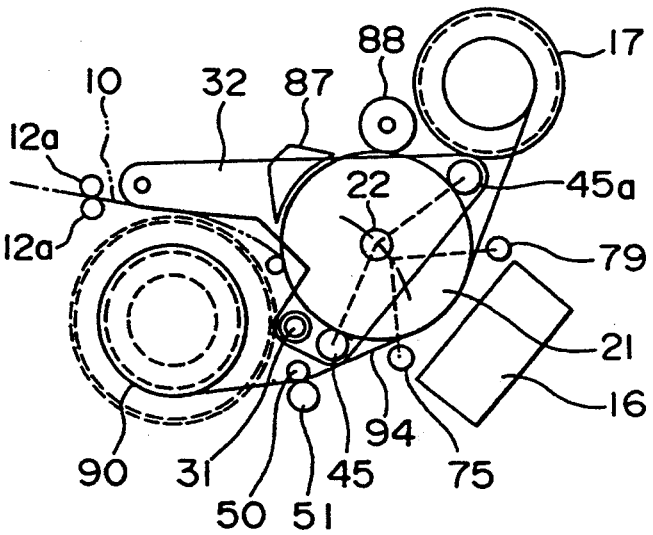
FIG. 21 is a schematic view showing a sheet feeding state of the apparatus of FIG. 1.
Figure 25:
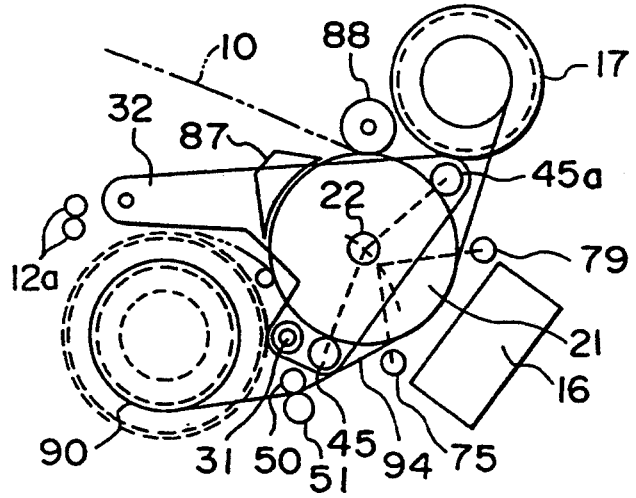
FIG. 25 is a schematic view showing a sheet discharging state of the apparatus of FIG. 1.

A left inner plate 5 is disposed proximate, and substantially parallel to the left side plate 4 and extends between the front and rear walls of the main chassis 3. A platen roller 21, formed of a resilient material such as rubber, is rotatably disposed between the left inner plate 5 and the right side plate 6, within the casing 2, for accepting a sheet 10 of a material to be printed on, such as paper, for example. For guiding the sheet material 10 to the platen roller 21, a guide plate 11 is provided. Below the guide plate, extending parallel to the platen roller 21, a substantially cylindrical, open-ended ink ribbon cartridge receptacle 13 is mounted in a forward portion of the interior of the casing 2. Further, a pair of sheet guide rollers. 12*a*, 12*a*, also made of a resilient material, are rotatably disposed on the front side of the sheet guide plate 11 so that a sheet 10, disposed on the guide plate 11 and which passes between the sheet guide rollers 12*a*, 12*a*, is fed to the platen roller 21 by rotation of the sheet guide rollers 12*a*, 12*a*. A guide roller 12*b* is disposed at the end of the guide plate closest to the platen roller 21 in the manner shown in FIG. 1. A sheet discharge guide plate 14 is disposed over the sheet guide plate 11 and guides the sheet 10, after traveling around the platen roller 21, to discharge the sheet 10 outside of the printer casing 2. FIGS. 21 and 25 show the positions of the guide rollers 12*a*, 12*a* in a state of guiding a sheet 10 to the platen roller 21 and after guiding a sheet 10 to the platen roller 21, respectively.

As seen in FIG. 1, a sub-chassis 15 is attached to the main chassis 3. The sub-chassis 15 is substantially L-shaped in lateral cross section so as to extend along a rear bottom corner portion of the main chassis 3. A thermal head 16 is attached to the sub-chassis 15 by set screws, or the like, so as to upwardly incline at a predetermined angle relative to the bottom wall of the main chassis 3 and longitudinally extends along the rear bottom corner portion of the main chassis 3. The sub-chassis 15 serves as a mount for installation of the thermal head 16, and the main chassis 3 serves as a heat radiator for releasing heat generated by the thermal head, from the casing 2.

Figure 2:
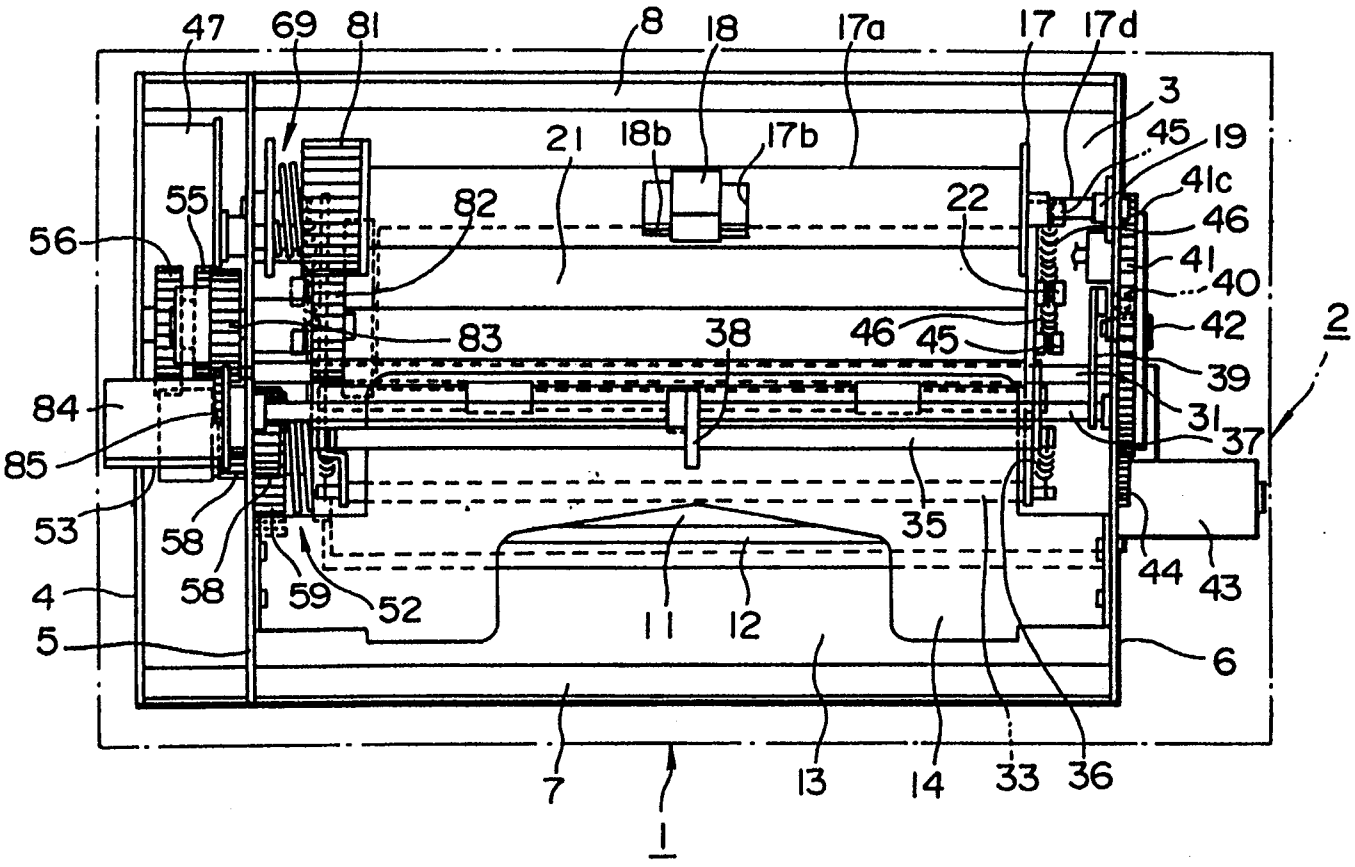
FIG. 2 is a plan view of the apparatus shown in FIG. 1.
Figure 3:
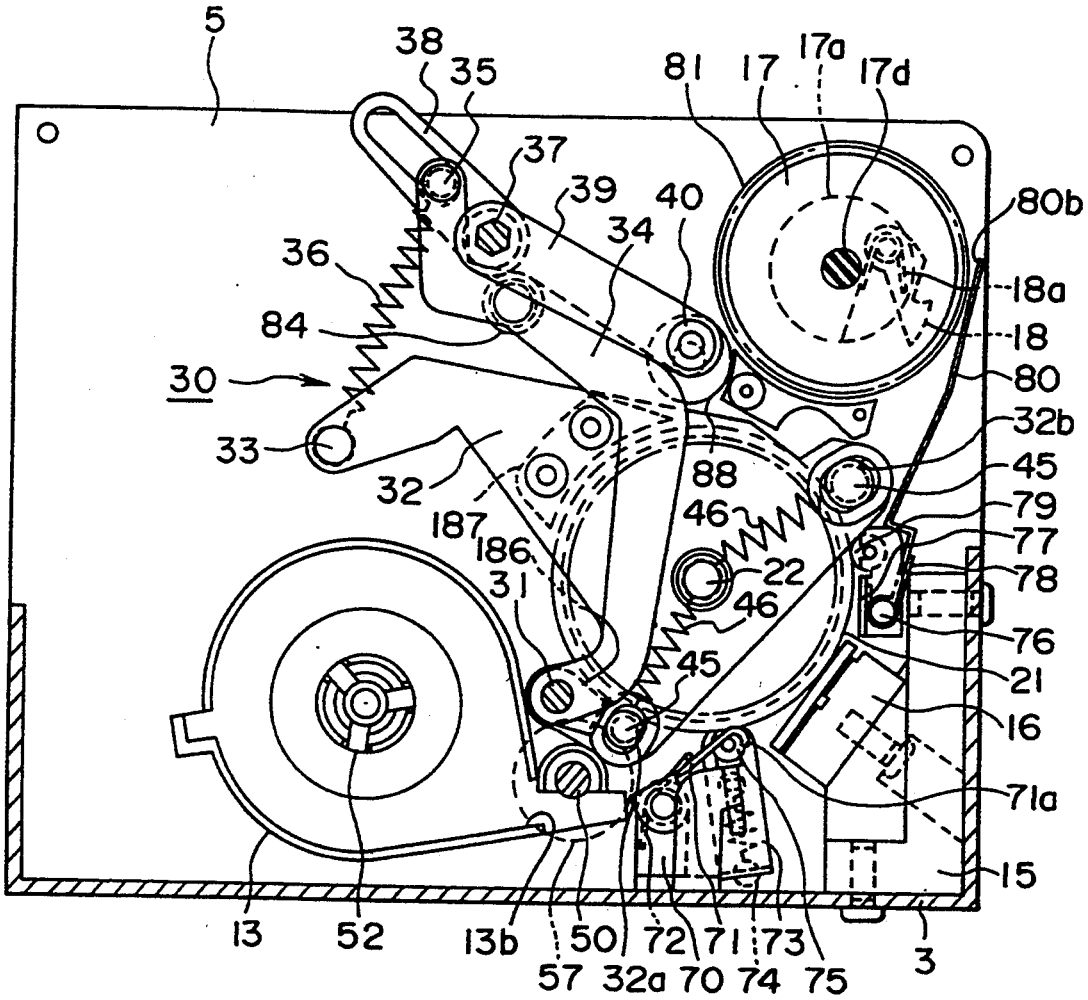
FIG. 3 is a sectional view of an inner portion of a right side panel of the apparatus of FIG. 1.
Figure 10:
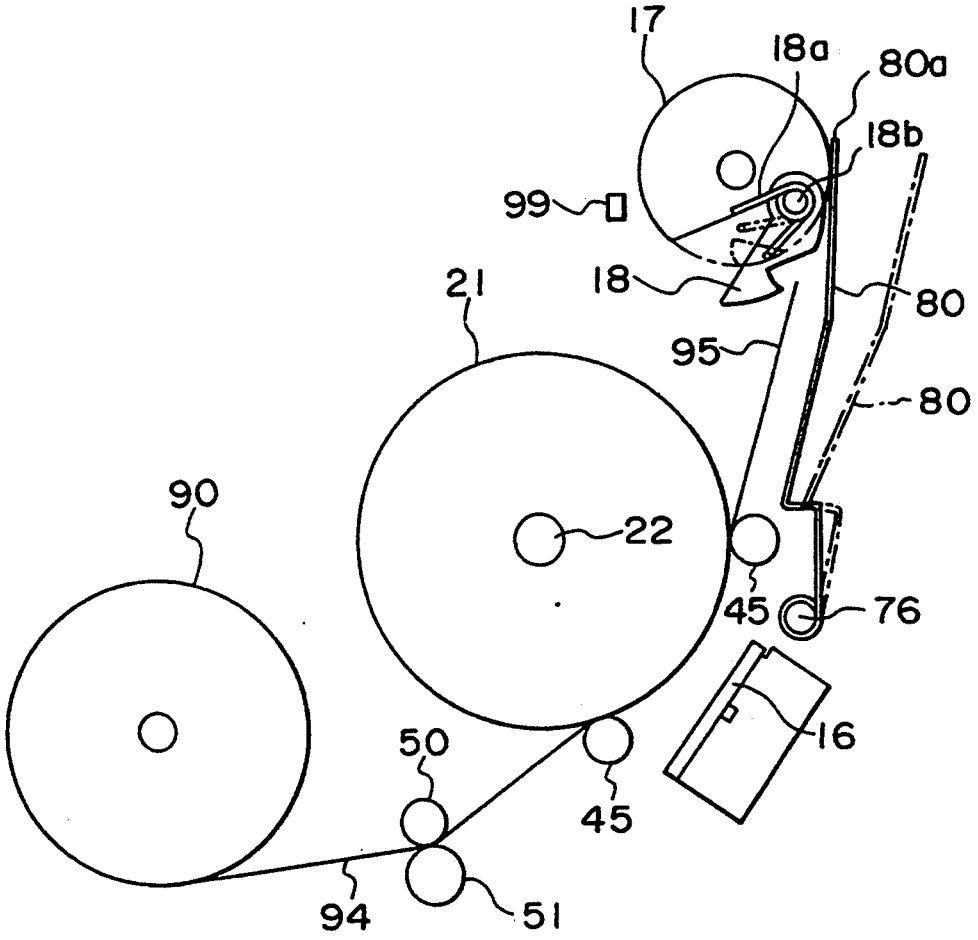
FIG. 10 is a schematic diagram of an ink ribbon chucking operation of the printer of the invention.

As seen in FIG. 2, a take-up reel shaft receiving portion 19 forms a support axis for a take-up reel 17 for used ink ribbon 94 unwound from an ink ribbon cartridge 90 in the ink ribbon cartridge receptacle 13. The take-up reel shaft receiving portion 19 is attached to the right side plate 6. At the other end of the take-up reel 17, proximate the left inner side plate 5, a rotatable take-up reel support projection 69 is interposed between the left inner side plate 5 and the take-up reel 17, so as to oppose the take-up reel shaft receiving portion 19. The take-up reel 17 extends longitudinally between the take-up reel shaft receiving portion 19 and the support projection 69, parallel to the platen roller 21 and includes a cylindrical body portion 17*a* therearound and has, at a mid-portion of its peripheral surface a recess 17*b*. As best seen in FIGS. 3 and 10 the recess 17*b* mounts a substantially L-shaped claw member 18 is mounted. As shown in FIG. 3, the claw member 18 is biased by a coil spring 18*a* to project outwardly from the recess of the body portion 17*a* so as to be engaged with a through hole 95*a* of the ink ribbon 94, for chucking the ink ribbon 94 upon loading of a new ink ribbon cartridge 90 in the ink ribbon cartridge receptacle 13. The platen 21 is associated with a platen driving mechanism 30, and a gear assembly 20 for driving the platen in both clockwise and counterclockwise directions for effecting printing on a sheet 10 by bringing the sheet into contact with the thermal head 16 by swinging action of the platen 21.

Figure 7:
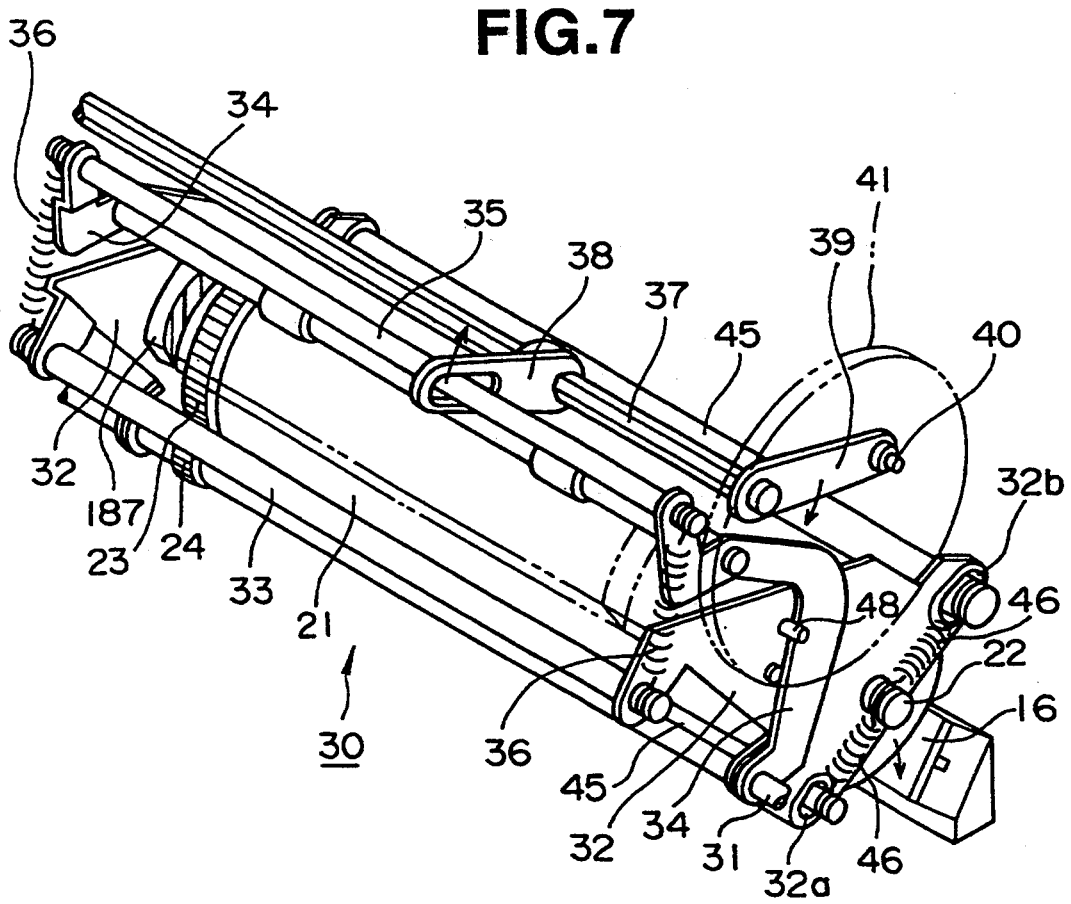
FIG. 7 is a perspective view of a platen driving mechanism of the apparatus of FIG. 1.

As seen in FIGS. 3 and 7 the platen driving mechanism comprises a shaft 31 journaled on the left inner and right side plates 5 and 6, and left and right support arms 32, 32 which are rotatably supported by the shaft 31 in the printer casing 2. Between the left and right support arms 32, 32, a support shaft 22 supporting the platen roller 21 is rotatably mounted. Each of the support arms 32, 32 is of a substantially triangular shape. The shaft 22 of the platen roller 21 extends through and beyond the plane of each of the supports arms 32 such that ends thereof project slightly outwardly from the support arms 32, 32. The ends of the shaft 31 extend through portions of the triangular shape of each of the support arms 32, 32 and are respectively mounted in the left inner side plate 5 and the right (inner) side plate 6. First and second corner portions of the lower part of the triangular shape of the support arms 32, 32 are provided with elliptical openings 32*a* and 32*b* respectively. Upper and lower pinch rollers 45*a*, 45 extend substantially parallel to the shaft 22 of the platen roller 21 and pass through the elliptical openings 32*a* and 32*b* opposingly provided in each of the support arms 32, 32. The upper and lower pinch rollers 4S, 45 are supported in the elliptical openings 32*a* and 32*b* such that both ends thereof are slidable in a radial direction. The pinch rollers 45, 45 urge the sheet 10 against a circumferential surface of the platen roller 21. Both ends of each pinch roller 45 are connected via resilient means, in this ease, coil springs 46, 46 to each end of the platen roller 21 support shaft 22, projected outwardly from an outer side of each of the support arms 32. The support arms 32, 32 are positioned such that the upper corners of the triangular shapes of the support arms 32, 32 are spaced forwardly of the lower corners thereof having the elliptical openings 32*a*, 32*b*. The forwardly spaced upper corner of each of the support arms 32, 32 supports an end of a bar 33, extending in parallel with the support shaft 22 of the platen roller 21. Substantially, L-shaped sub-support arms 34, 34 are rotatably mounted on both ends of the shaft 31 so as to project from the support arms 32, 32. Each of the sub-support arms 34, 34 has one end mounted on the shaft 31 and the other end supporting a bar 35. The bar 35 passes through each of the sub-support arms and is securely supported at both ends thereby. Each end of the bar 35, projecting outwardly From each of the sub-support arms 34, 34 is connected via coil springs 36, 36 to respective ends of the bar 33 projecting outwardly from the support arms 32, 32.

As seen in FIGS. 2, 3 and 7, the platen roller driving mechanism 30 also includes a drive shaft 37 which is rotatably supported at both ends thereof by the left inner side plate 5 and the right side plate 6, substantially parallel to the bar 35 of the sub-support arms 34, 34. The drive shaft 37 and the bar 35 are connected with each other via an oval shaped link member 38. The link member 38 has an end secured to a mid-portion of the drive shaft 37 and a tapered end having an elongated hole through which the bar 35 passes. A driving arm 39 is mounted on the drive shaft 37 adjacent and inside of the right side plate 6. The driving arm 39 has one end secured to the driving shaft 37 and the other end provided with a pin 40 which extends outwardly therefrom so as to project from an outer face of the right side plate 6. On the outer face of the right side plate 6 is mounted a shaft 42 on which a cam gear 41 is rotatably supported (see FIGS. 1 and 2). As seen FIGS. 1 and 2, the cam gear 41 has, on an inner face thereof, a first cam groove **41*a* into which the pin 40 is fitted to act as a cam follower. The cam gear 41 is engaged with a driving gear 44 driven by a motor 43 which is secured to an upper portion of the outer face of the right side plate 6**.

Figure 4:
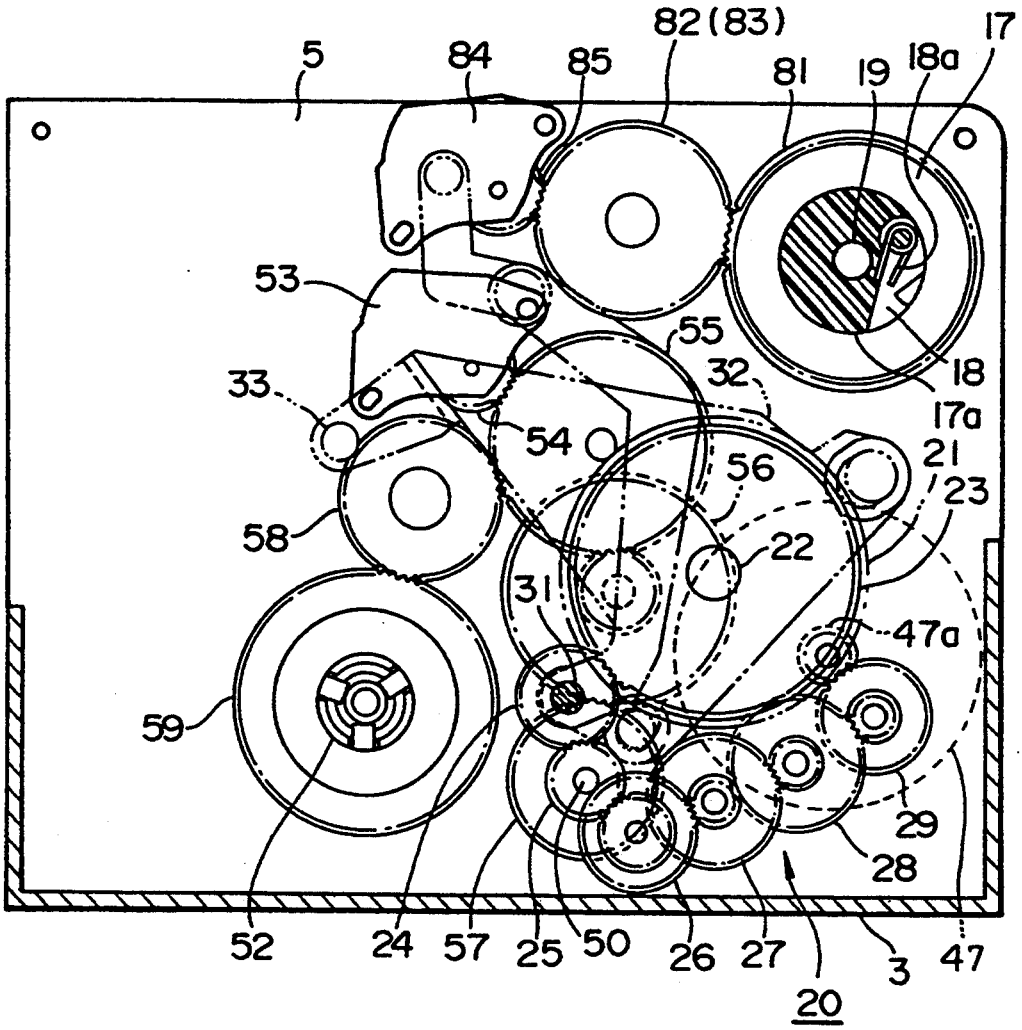
FIG. 4 is a schematic view showing a drive mechanism of the apparatus of FIG. 1.

As seen in FIGS. 4 and 7, a platen gear 23 is secured to the left side of the platen roller 21. The platen gear 23 is associated with a platen rotating mechanism 20, which is essentially a gear assembly as will be described hereinbelow.

Figure 8:
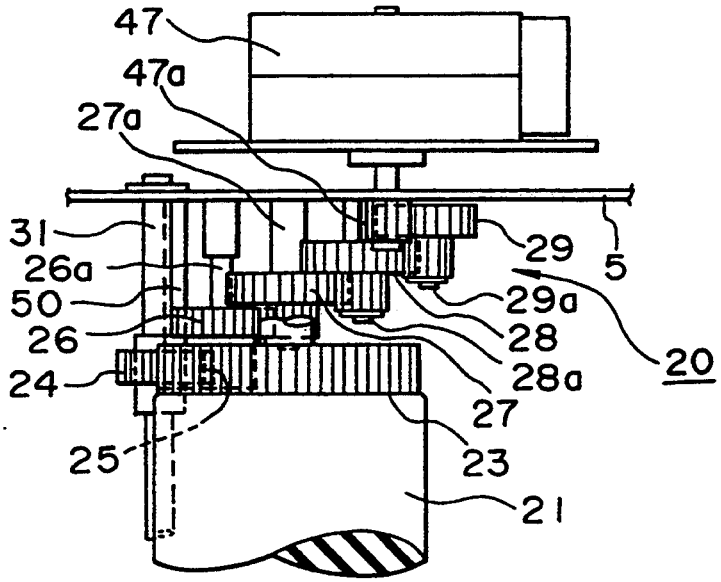
FIG. 8 is a plan view of a gear group utilized for rotating the platen roller of the printer of the invention.
Figure 9:
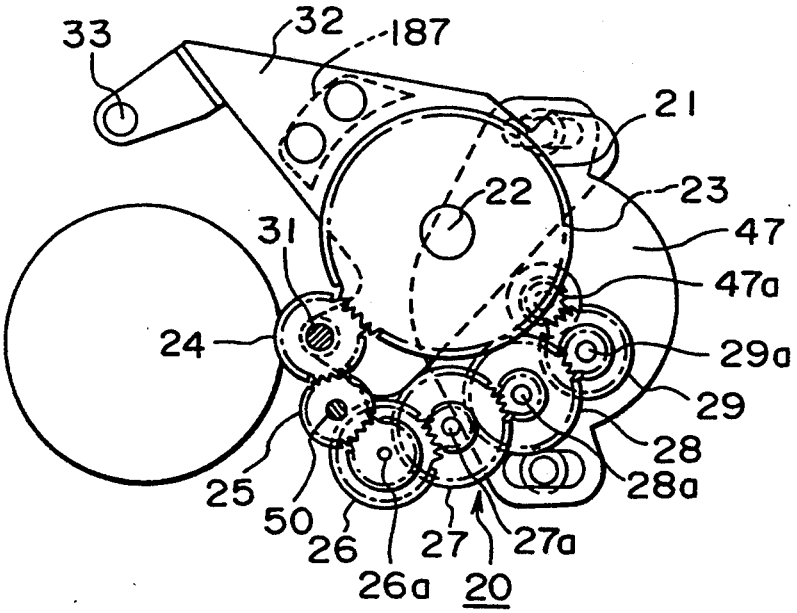
FIG. 9 is a side view of the gear group of FIG. 8 showing engagement of the various gears used in the apparatus of FIG. 1.

Referring to FIGS. 8 and 9, the gear 23 is opposed to an inner face of the left support arm 32. The platen gear 23 is operably associated with the gear assembly of the platen rotating mechanism 20 arranged inside the left inner plate 5. The platen rotating mechanism 20 comprises first through sixth gears 24 to 29. The first gear 24 is rotatably mounted on the shaft 31 arranged between the support arms 32, 32 and is engaged with the platen gear 23 fixed on the side of the platen roller 21. The second gear 25 is rotatably supported on a capstan shaft 50 extending longitudinally and disposed over an inlet/-outlet **13*b* of the ink ribbon cartridge receptacle 13 through which the ink ribbon 94 passes. The second gear 25 is engaged with the first gear 24 and the third gear 26. The third to sixth gears 26 to 29 are rotatably supported on respective shafts disposed on an inner face of the left inner plate 5. The sixth gear 29 is engaged with a driving gear 47*a* disposed inside the left inner plate 5. The driving gear 47*a* is connected to a motor 47 mounted on an outer face of the left inner plate 5, so that the gear assembly comprising the platen rotating mechanism 20 is rotated via the driving gear 47*a* by the motor 47**.

According to the above construction, the platen driving mechanism 30 enables rotation of the platen roller 21 while the platen is moved toward and away from the thermal head 16.

The ribbon cartridge receptacle 13 is arranged between the left inner plate 5 and the right side plate 6 with an opening for insertion of a ribbon cartridge 90 facing in an upward direction. The capstan shaft 50 is rotatably positioned near the opening **13*b* of the ribbon cartridge receptacle 13 so as to contact a pinch roller 51 for cooperatively rotating together for extracting the ink ribbon 94 From the ink ribbon cartridge 90 held in the ribbon cartridge receptacle 13. In addition, a supply reel mount 52 operatively engages a supply reel 93 within the ribbon cartridge 90 for rotating the supply reel 98, extracting the ink ribbon 94 for effecting printing operation. The supply reel mount 52 and the capstan shaft 50 are driven by a motor 53 mounted between the left side plate 4 and the left inner plate 5. As seen in FIG. 4, a driving gear 54 is driven by the motor 53 and engaged with a first intermediate gear 55 disposed on the outer face of the left inner plate 5. Rotation of the first intermediate gear 55 is transmitted to a second intermediate gear 56 disposed on a inner face of the left side plate 4. The second intermediate gear 56 is engaged with a gear 57 secured to an end of the capstan shaft 50. As a result, the capstan shaft 50 is rotated by the motor 53. As shown in FIG. 2, intermediate gears 58, 58 are disposed on inner and outer faces of the left inner plate 5, respectively. As shown in FIG. 4, the gear 58 on the outer face of the left inner plate 5 is engaged with the first intermediate gear 55 while the gear 58 on the inner face of the left inner plate 5 is engaged with a gear 59 secured to the ink ribbon supply reel mount 52. Thus the ink ribbon supply reel mount 52 is also driven by the motor 53**.

Figure 6:
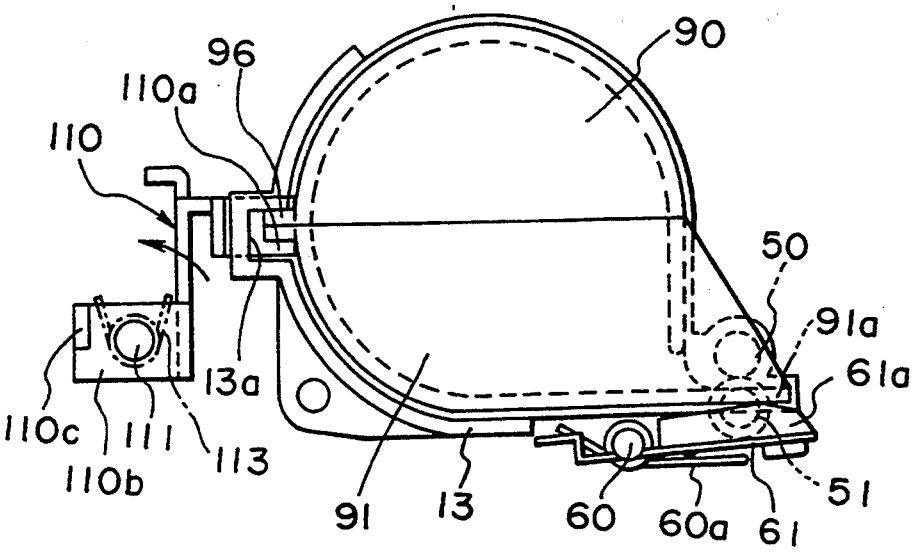
FIG. 6 is a side view of the ink ribbon cartridge and receptacle therefor, as shown in FIG. 5.

Referring to FIG. 6, the pinch roller 51, disposed between the left inner plate 5 and the side plate 6 is positioned near a shaft 60 to which a oscillating plate 61 is attached which is movable in upward and downward directlobs. The edge portion of the oscillating plate 61 is provided with a pair of cut-out portions for accommodating ribbon guide portions **91*a*, 91*a* of the ink ribbon cartridge 90. Corresponding to the cut-out portions of the oscillating plate 61, a pair of shaft receiving plates 61*a*, 61*a* are provided, the shaft receiving plates 61*a*, 61*a* rotatably mount the pinch roller 51 therebetween. Further, a coil spring 60*a* is provided for biasing the oscillating plate 61** in the upward direction.

Figure 15:
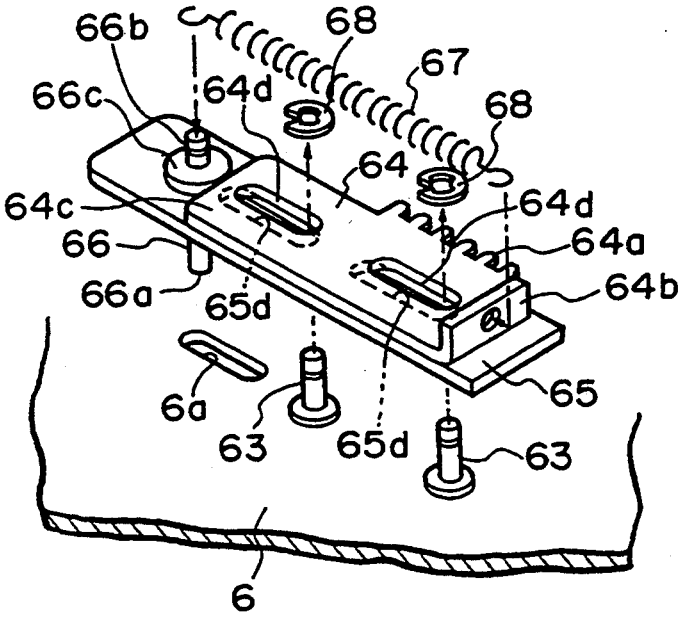
FIG. 15 is an exploded perspective view of a slide plate arrangement utilized in the printer of the invention.

Referring to FIGS. 1 and 15, the oscillating plate 61 is provided, at its right end, with an arcuate rack 62. The rack 62 is engaged with a rack **64*a* which is formed on a lower-front portion of a slider 64. The slider 64 is substantially vertically slidable along pins 63, 63 which are projected inwardly from an inner face of the right side plate 6. As seen in FIG. 15, a sliding plate 65 is arranged adjacent the rack 64*a* to be slidable in a substantially vertical direction along the pins 63, 63. Both the slider 64 and the slide plate 65 have corresponding longitudinally extended openings 64*d*, 64*d* and 65*d*, 65*d* respectively for receiving the pins 63, 63. The sliding plate 65 is penetrated, at an upper end portion thereof, with a pin 66 having ends 66*a*, 66*b* projecting therefrom in both outward and inward directions respectively (upward and downward directions in FIG. 15). The outward facing end 66*a* of the pin 66 passes through an enlongate opening 6*a* of the right side plate 6 so as to engage a second cam groove 41*b* which is formed on an inner face of the cam gear 41. On the other hand, the inward facing end 66*b* of the pin 66 is connected to a lower end portion 64*b* of the slider 64 via a coil spring 67. The slider 64 and the slide plate 65 are held to the side plate 6 via washers 68, 68 attached over the pins 63, 63. Also, at a central upper portion of the pin 66, a flange 66*c* is provided. The flange 66*c* serves as a limiter, contacting an upper edge 64*c* of the slider 64, for establishing an uppermost position of the slider 64 and the slide plate 65**.

As seen in FIG. 3, a bracket 70 is disposed on the bottom wall of the main chassis 3 so as to be positioned below the platen roller 21. An ink ribbon guide plate 71 is pivotally supported around a pin disposed on the bracket 70. The guide plate 71 has a top end 71*a* biased downwardly by a spring 72. A lower ink ribbon guide 73, biased in the upward direction by a spring 74, is attached to the bracket 70. The lower ink ribbon guide is provided with an ink ribbon guide roller 75 which is rotatably supported at a top end of the lower ink ribbon guide 73. An upper ink ribbon guide 77 is rotatably supported on a shaft 76 at a position over the thermal head 16 and has an ink ribbon guide roller 79 near a top end thereof. The upper ink ribbon guide 77 is biased toward the platen roller 21 by a spring 78 such that the ink ribbon guide roller 79 is urged against the circumferential surface of the platen roller 21.

Figure 11:
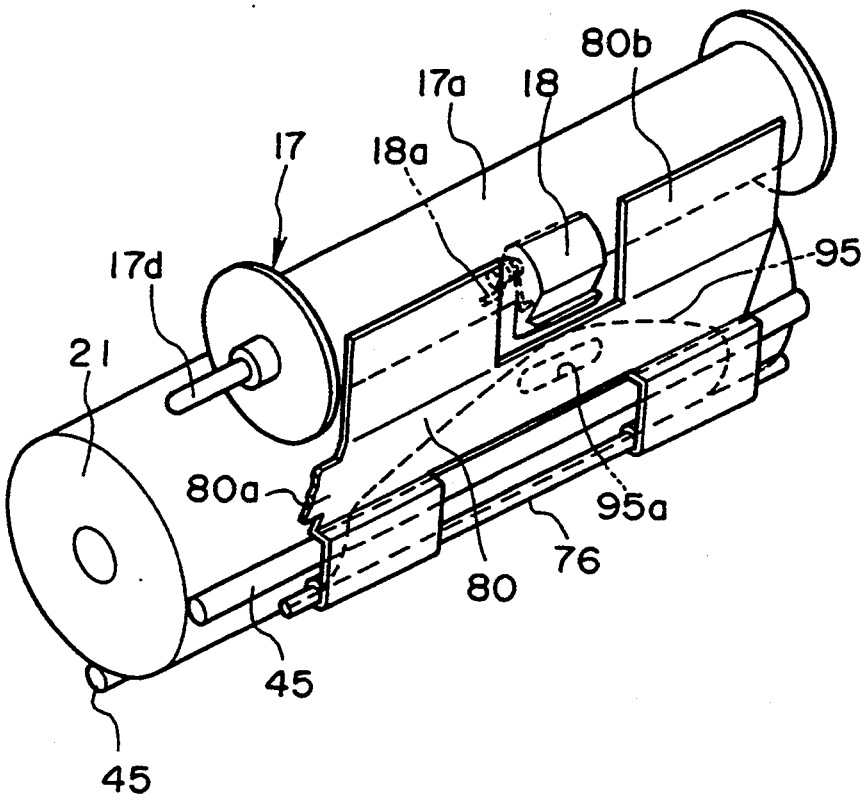
FIG. 11 is a perspective view of a take-up reel and platen roller of the printer of FIG. 1 for depicting an ink ribbon chucking operation.
Figure 12:
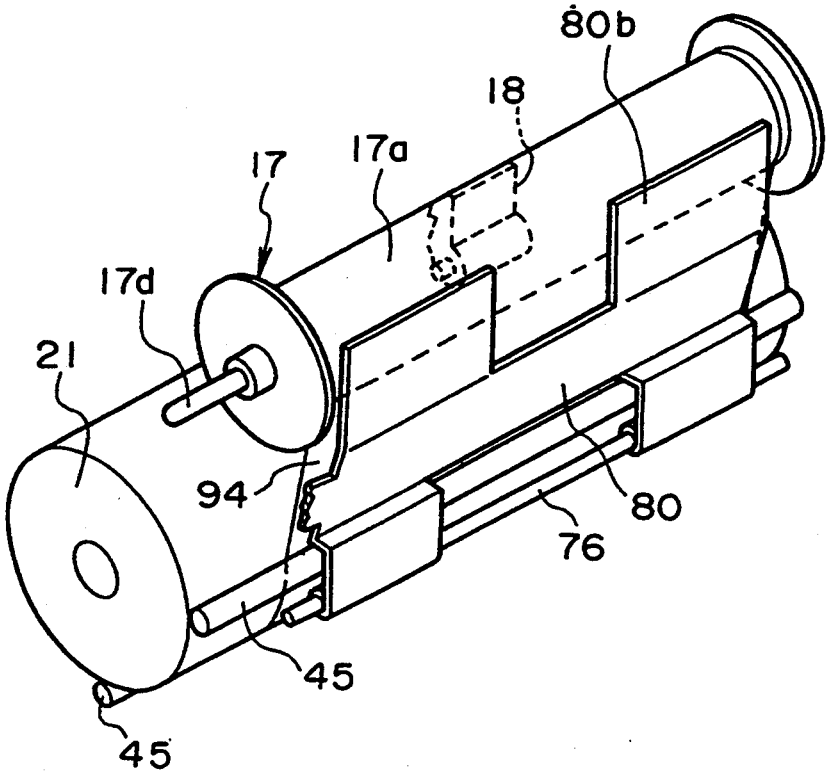
FIG. 12 is another perspective view of the take-up reel and platen roller of the printer of FIG. 1 depicting a chucked condition of the ink ribbon.

Furthermore, as seen in FIGS. 10, 11 and 12, on the shaft 76 an ink ribbon guide control plate 80 is supported. The ink ribbon guide control plate 80 has a distal end portion 80*b* and a protrudent portion 80*a* at a lower-right portion thereof, as shown in FIG. 1. The protrudent portion 80*a* cooperates with a circumferential face of a cam projection 41*c* projecting outwardly from an outer face of the cam gear 41. The ink ribbon guide control plate 80 is biased toward the body portion 17 of the take-up reel 17 by a spring (not shown). Back-tensioning provided by the spring allows the ribbon guide control plate 80 to remain in pressing contact with the ink ribbon 94 as it is wound around the cylindrical body portion 17*a* of the take-up reel 17, as the diametric profile of the outer circumference thereof is changed due to winding of the ink ribbon 94. As can be seen in FIGS. 11 and 12, shaft 17*d* of the take-up reel 17 projects from one side of the take-up reel 17, while a U-shaped indentation 17*c* is formed in the other end thereof.

Figure 13:
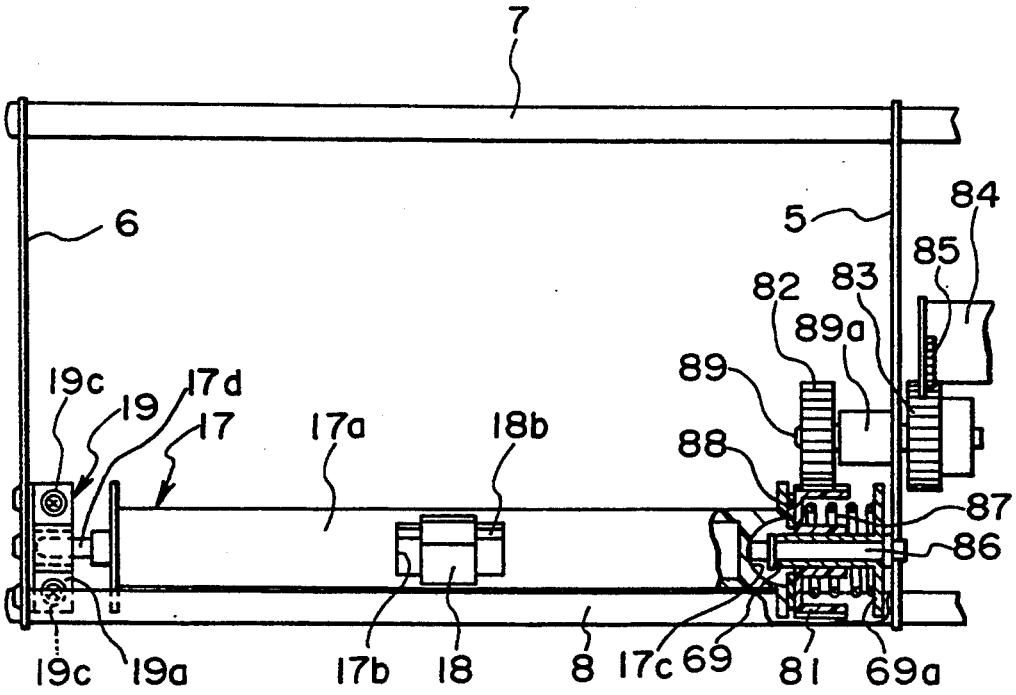
FIG. 13 is a plan view of a take-up reel mounting arrangement of the printer of FIG. 1.
Figure 14:
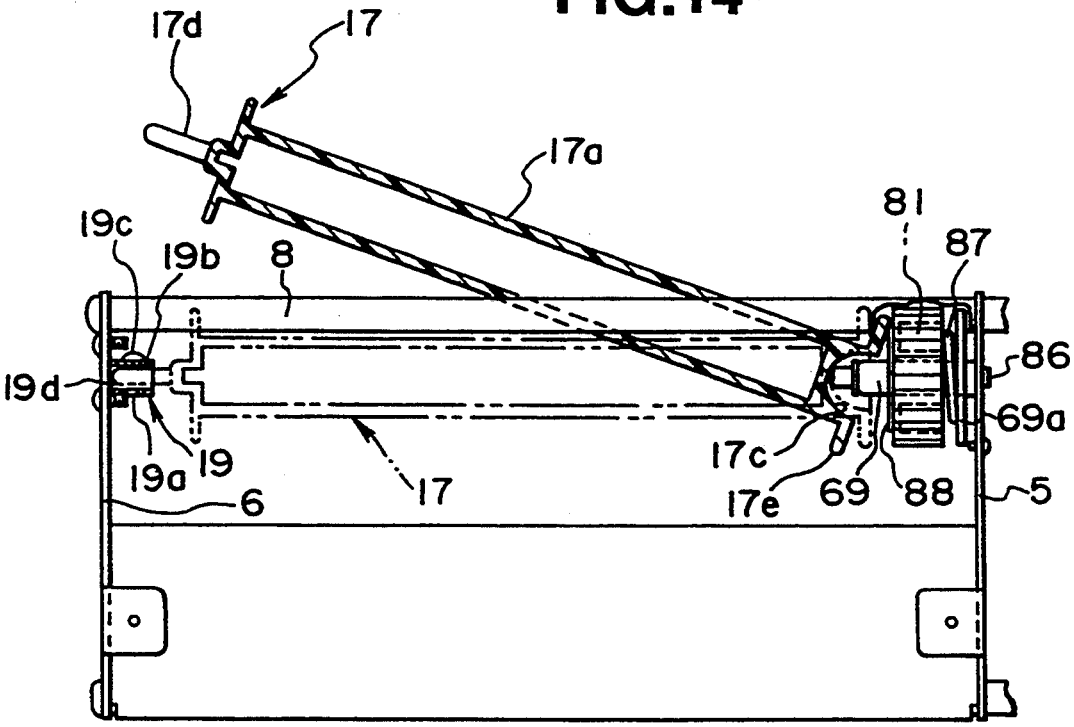
FIG. 14 is a rear view of the take-up reel mounting arrangement of FIG. 13.

As shown in FIGS. 13 and 14, the left end of the take-up reel 17, provided with the U-shaped indentation 17*c* is positioned such that the take-up reel support projection 69 is inserted into the U-shaped indentation 17*c* to establish a locking fit therein so as to enable co-rotation of the support projection 69 and the take-up reel 17. A gear 81 is rotatably disposed around the take-up reel support projection 69 for rotation therewith. The take-up reel support projection 69 and the gear 81 are coaxially disposed on a shaft 86 which is mounted at one end to the left inner plate 5. A flange portion 69*a* is provided a an end of the take-up reel support projection 69 proximate the left inner plate 5 and a coil spring 87 is disposed around the take-up reel support projection 69 for biasing the gear 81 in a direction toward the take-up reel 17. The face of the gear 81 facing a flange 17*e* of the take-up reel 17 is provided with a pad 88, of felt material or the like, for protecting the gear 81 and the take-up reel 17 from damage when the take-up reel 17 is removed from the printer.

Referring to FIG. 13, the gear 81 is engaged with a gear 82 which is mounted on a shaft 89 and held at a position away from the right side plate 6 by a spacer 89*a*. Also mounted on the shaft 89 on the outer face of the right side plate 6 a gear 83 is secured for co-rotation with the gear 82, the gear 83 engages a driving gear 85 driven by a motor 84 mounted on an outer side of the right side panel 6. Thus the driving gear 85, drives the gears 83 and 82 via the motor 84 to turn the gear 81 for controlling rotation of the take-up reel 17.

The take-up reel shaft receiving portion 19 comprises spacer portions 19*d*, 19*d* separating an upper plate 19*b* and a lower plate 19*a*, the upper and lower plates 19*a* and 19*b* are secured together with the spacers 19*d*, 19*d* interposed therebetween by screws 19*c*. The take-up reel shaft receiving portion 19 is mounted to the inner face of the right side plate 6 by screws, or the like. It will be noted that, alternatively the take-up reel shaft receiving portion 19 may be integrally formed of a single material, or that the spacer portions 19*d* may be formed as part of the upper or lower plates 19*a*, 19*b*.

As best seen in FIG. 14, for removal operation of the take-up reel 17, the take-up reel 17 may be pushed in a direction toward the left inner plate 5, against the force of the spring 87 biasing the gear 81, thus displacing the take-up reel 17 in that direction and freeing the support projection 17*d* from the take-up reel shaft receiving portion 19. The end of the take-up reel 17 having the support projection 19 may then be lifted from the printer apparatus and the take-up reel 19 may be easily extracted therefrom. It will be noted that as the end of the take-up reel 17 having the support projection 17*d* is lifted, the angular relationship between the support projection 69 and the U-shaped indentation 17*c* is changed and the flange 17*e* is pressed against the pad 88, further displacing the gear 81 in a direction toward the right side plate 6 and easy removal of the take-up reel 17 is facilitated.

Figure 16:
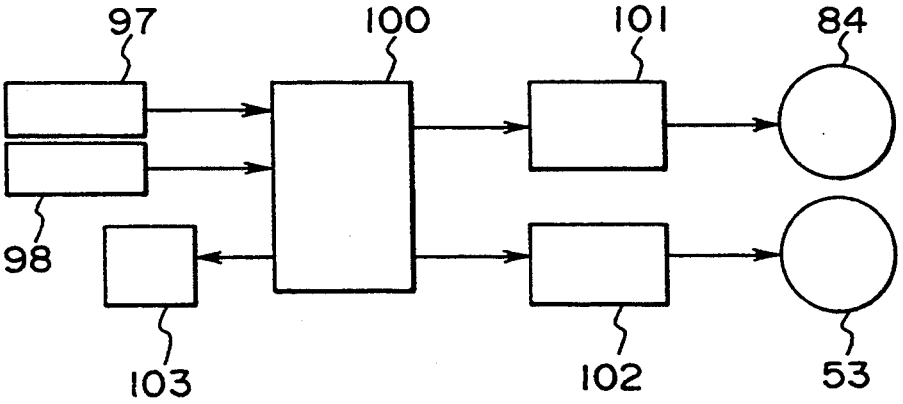
FIG. 16 is a schematic diagram of an positioning operation of the ink ribbon according to the invention.
Figure 17:
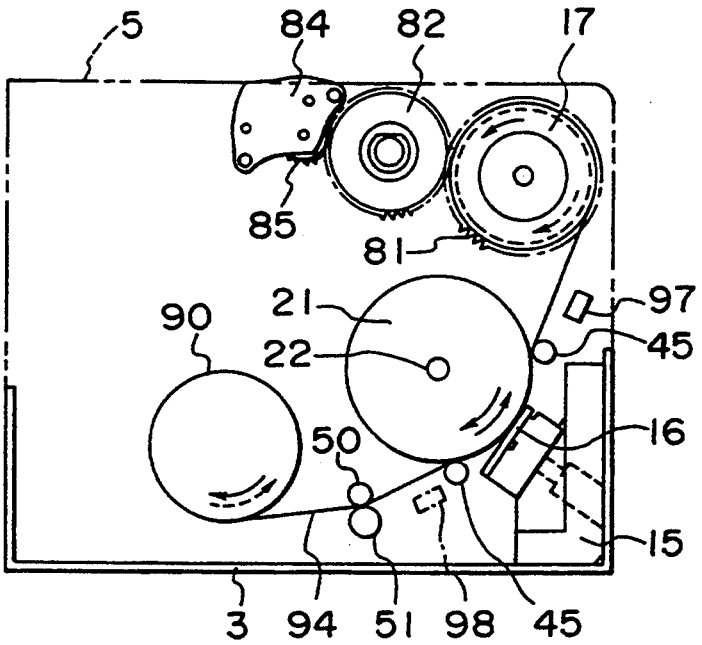
FIG. 17 is a schematic diagram for showing a winding operation of according to ink ribbon the the printer of the invention.
Figure 18:
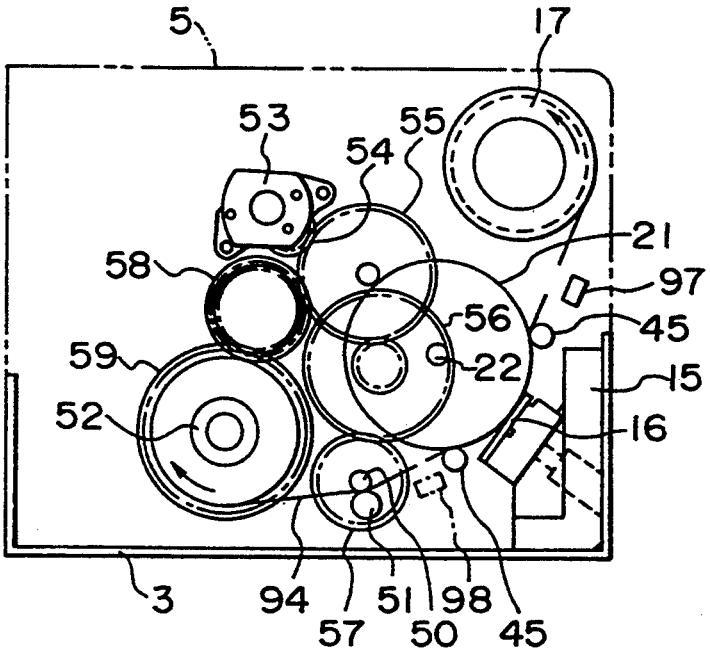
FIG. 18 is a schematic diagram for depicting an operation of the printer which occurs when an ink ribbon thereof is broken or cut.

As seen in FIGS. 17 and 18, light sensors 97, 98 are provided in the printer casing 2 at positions above and below the platen roller 21 for detecting markers (not shown) provided on the ink ribbon 94 for assuring accurate positioning of the ink ribbon 94 in printing operation. In FIG. 18 the markers are represented by broken line portions of the ink ribbon 94. If for example, the ink ribbon is cut or broken the markers cannot be read by the sensors 97, 98. FIG. 16 shows a control system for the printer of the invention controlled by a CPU 100. First markers from the ink ribbon 94 are read by the sensors 97, 98 and data indicative thereof is transmitted to the CPU 100. Then the CPU sends signals to motor control circuits 101, 102 for controlling motor 84, associated with the gears 85, 83, 82, and 81 for driving the take-up reel support projection 69 and motor 58 for controlling a position of a supply reel mount 52 for driving the supply reel 93 of the ink ribbon cartridge 90, respectively, for driving the motors so as to accurately position the ink ribbon 94 for a particular operation, such as printing a first color, printing a second color, etc. Further, an alarm circuit 103 is provided for signaling failure of operation due to breaking of the ink ribbon, jamming, or finishing of the available ink ribbon on the ink ribbon cartridge.

Figure 19:
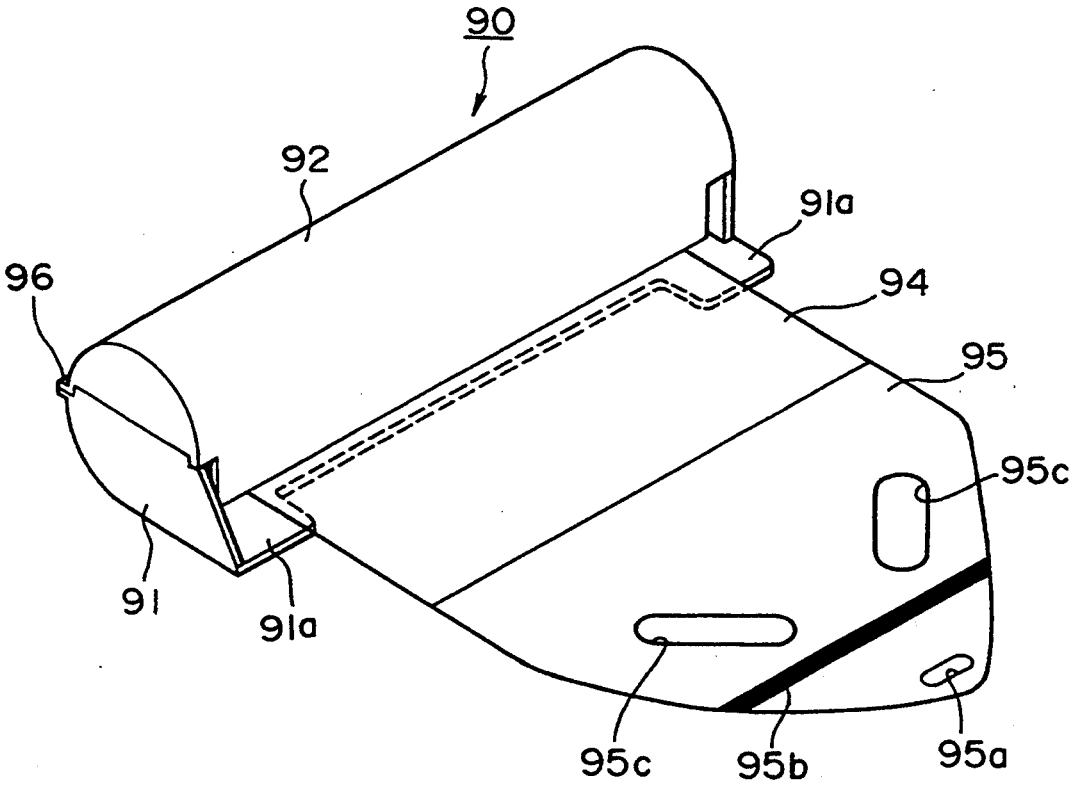
FIG. 19 is a perspective view of an ink ribbon cartridge utilized by in the apparatus of FIG. 1.

FIG. 19 shows the construction of a single reel type ink ribbon cartridge 90 for use with the printer of the invention. As seen in the drawing, the ink ribbon cartridge comprises an upper casing 92, a lower casing 91 including protrudent lower ribbon guide portions 91*a*. The ink ribbon 94 is contained on a supply reel 93 (not shown) disposed between the upper and lower casings 92, 91. The supply reel 98 may be spring biased, for example, to as to provided backtensioning to an unwound portion of the ink ribbon 94. An initial, or end portion of the ink ribbon 94 is attached to a pull tab 95 to facilitate chucking of the ink ribbon 94 in the printer. 1. The pull tab includes a through hole 95*a* for engaging the claw portion 18 associated with the take-up reel 17 for enabling winding of the ink ribbon 94 around the take-up reel 17. Also provided on the pull tab 95 are notches 95c, 95c and a marker 95b. The marker 95b detected, by a sensor 99, (see FIG. 10) so that an initial winding of the ink ribbon 94 around the take-up reel 17 is recognized by the CPU 100. The notches 95c, 95c serve for restraining wrinkling of the ink ribbon 94 when being drawn out of the ink ribbon cartridge 90. According to the present embodiment, the ink ribbon has thereon continuous color regions grouped in repeating distinct blocks, such as yellow (Y), magenta (M), cyan (C), yellow (Y), magenta (M), . . . for example. FIG. 10 shows a condition in which the ink ribbon 94 has been initially extracted from the ink ribbon cartridge 90 and wound around the body portion 17a of the take-up reel 17 via the platen roller 21.

Figure 5:
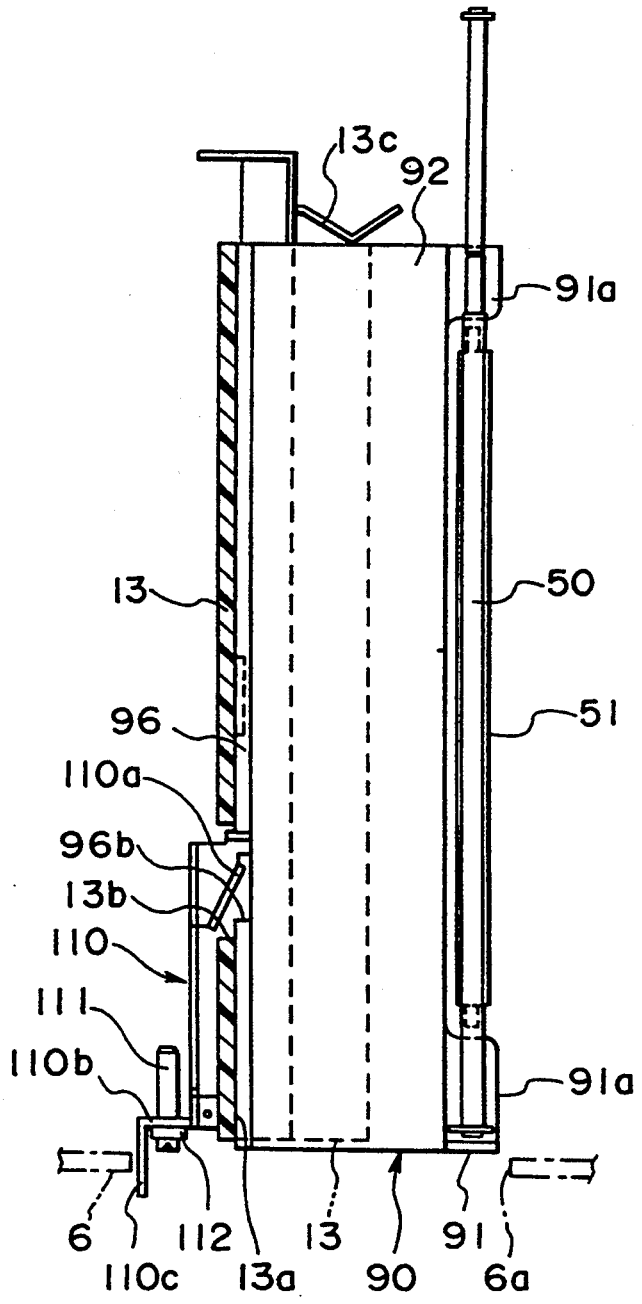
FIG. 5 is a plan view of an ink ribbon cartridge receptacle of the printer of FIG. 1 showing an ink ribbon cartridge loaded therein.

Referring to FIGS. 5 and 6, when the ink ribbon cartridge 90 is set in the semicircular shaded ink ribbon cartridge receptacle 13, retained therein by a plate spring member 13c provided at one end of the cartridge receptacle 13, a longitudinal projecting portion 96 is projected from the rear side of the upper and lower casings 92, 91 along a line at which the upper and lower casings 92, 91 meet into a receiving groove 13a of the ink ribbon cartridge receptacle 13. As seen in FIG. 5, the longitudinal projecting portion 96 is provided with a cut-out portion 96b. Further, the receiving groove 13a of the ribbon cartridge receptacle 13 is provided with a cut-out portion 13b substantially corresponding to the position of the cut-out 96b of the ink ribbon cartridge 90. The cut-out portions 13b and 96b are provided for allowing the ink ribbon cartridge 90 to be engaged with a lock level 110, as best seen in FIG. 6. The lock lever 110 has at a center portion thereof a lock 110a for retaining the ink ribbon cartridge 90 securely in the ink ribbon cartridge receptacle 13. The lock 110a is of a tapered configuration. The lock lever 110 is mounted on a shaft 111 which is attached to a bracket 112 on the inner face of the right side plate 6. The lock lever 110 mounted on the shaft 111 is biased by a coil spring 113 in the direction of the arrow in FIG. 6 so as to maintain the lock portion 110a always in the cut-out portion 13b of the ink ribbon cartridge receptacle 13. According to this arrangement, the ink ribbon cartridge receptacle is moved slightly in the direction of the arrow of FIG. 6 according to unwinding of the ink ribbon 94 of the ink ribbon cartridge 90 for always maintaining secure locking of the ink ribbon cartridge 90 when installed in the printer 1. An arm portion 110c of the lock lever 110 is projected through the right side plate 6 through a cut-out 6b provided the side plate 6. The arm portion 110c is associated with a lever (not shown) positioned on the outer side of the right side plate 6 for effecting locking of the ink ribbon cartridge 90 in the ink ribbon cartridge receptacle 13.

In addition, in FIG. 1, numeral 186 refers to a guide plate, associated with the sheet guide plate 11 for guiding a sheet 10 of printing material to the platen roller 21. Also, a fence plate 187, or synthetic resin or the like is provided for maintaining an edge on the sheet 10 in contact with the platen during winding of the platen in clockwise and counterclockwise directions to prevent tearing or wrinkling of the sheet 10 during printing operation.

In the above-described embodiment of a color printer according to the invention, the supply sheet guide plate 11 is disposed at a paper supply side of the printer casing 2 for guiding sheets 10 of the printing material to the platen 21. At a right side of the printer casing 2 the lock lever 110 for locking an ink ribbon cartridge 90 in the ink ribbon cartridge receptacle 13 is arranged. When the lock lever is engaged the slider, including the slide plate 64 etc., disposed at a side of the ink ribbon cartridge 90 from which the ink ribbon 94 is extracted, slides in the upward direction. By this action the pinch roller 51 rotatably disposed between the shaft receiving plates 61a, 61a of the oscillating plate 61 is urged in the direction of the capstan shaft 50 for making touching contact between the pinch roller 51 and the capstan shaft 50, thus gripping the pull tab 95 of the ink ribbon 94 therebetween. In this condition the ink ribbon guide portions 91a, 91a of the lower casing 91 of the ink ribbon cartridge 90 are positioned between the pair of shaft support plates 61a, 61a of the oscillating plate 61. Therefore, when touching contact is effected between the capstan shaft 50 and the pinch roller 51, the ink ribbon cartridge is smoothly positioned for effecting extraction of the ink ribbon 94 from the ink ribbon cartridge.

Then, rotation of the capstan shaft 50 is effected for pulling the pull tab 95 and urging same in the direction of the platen 21. The pull tab 95 is then wound counterclockwise around the platen 21 extracting the ink ribbon 94 from the ink ribbon cartridge 90 and the pull tab 95 is urged in the direction of the take up reel 17. As seen in FIGS. 10 and 11, the edge 80b of the ink ribbon guide plate 80 urges the pull tab 95 toward the body 17a of the take-up reel 17. The take-up reel is rotated in the counterclockwise direction and the claw 18, outwardly biased by the spring 18a, catches the through hole 95a of the pull tab 95 thus catching the pull tab 95 to effect winding of the ink cartridge 94 around the take-up reel 17. At this time, the sensor 99 is effective to detect the marker 95b provided on the pull tab 95 for establishing a correct initial winding position for the ink ribbon 94 relative the thermal head 16 such that printing operation may be undertaken according to control by the CPU 100. Thus chucking operation for the ink ribbon 94 is greatly simplified according to the invention.

Also, as shown by a broken line in FIG. 10, after the ink ribbon is sufficiently wound around the take-up reel 17, the ink ribbon guide plate 80 is moved in a direction away from the cylindrical body portion 17a of the take-up reel so as to separate from contact with the ink ribbon 94 and the take-up reel 17.

Hereinbelow a printing operation of the preferred embodiment of the invention will be described with reference to FIGS. 20–25.

Figure 20:
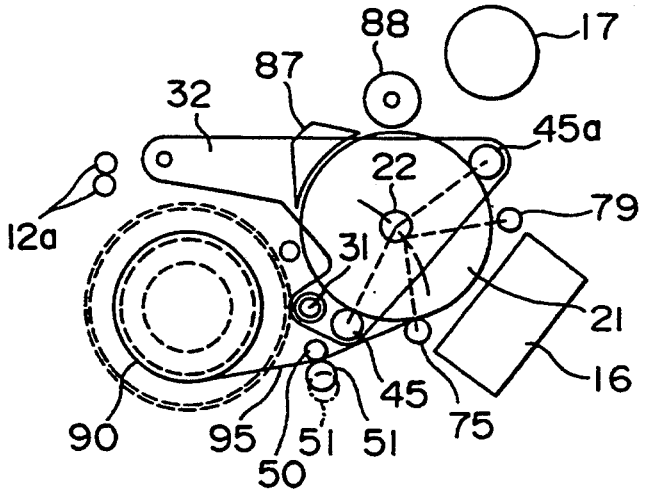
FIG. 20 is a schematic view showing an mounted state of a ink ribbon cartridge in the apparatus of FIG. 1.

First, as seen in FIG. 20, the ink ribbon 94 is extracted and supplied to the take-up reel 17 as already described above.

Figure 22:
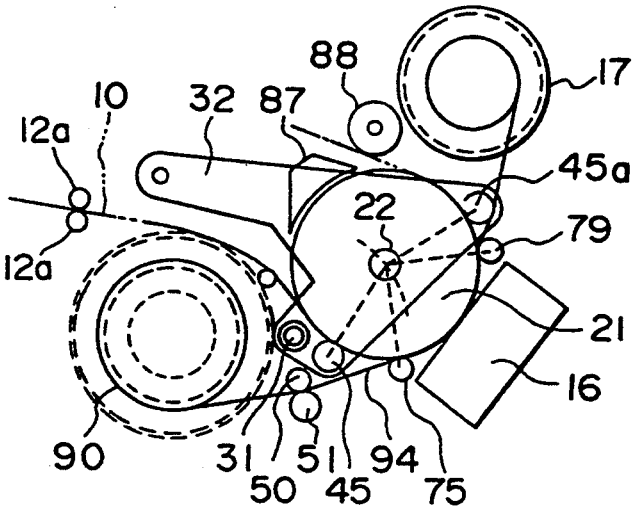
FIG. 22 is a schematic view showing a state of the apparatus of FIG. 1, during printing.

Then, as seen in FIG. 21, a sheet 10 of paper, etc., from the supply sheet guide plate 11 is supplied through the guide rollers 12a, 12a to be wound counterclockwise around the platen roller 21, being interposed between the platen roller 21 and a lower pinch roller 45. Then, as shown in FIG. 22, as the paper is engaged between the lower pinch roller 45 and the platen roller 21 the platen driving mechanism 30 is operative to swing the platen roller forward and downward. While the swinging motion of the platen roller is being effected the platen roller is rotated to bring an upper edge of the sheet 10 around the platen roller to a point at which the upper edge contacts the upper pinch roller 45a, in contact with the platen roller 21. Thus, the sheet 10 is positioned for printing a first color (i.e. yellow Y) concurrently with the movement of the platen roller downwardly for contacting the ink ribbon 94 with the thermal head 16, the sheet 10 being interposed between the ink ribbon 94 and the platen roller 21 in the manner illustrated in FIG. 22. The thermal head 16 is then energized and printing of the first Y image is effected while the platen roller is rotated in a counterclockwise direction, At an end of the energization, or printing time of the thermal head 16, the platen roller 21 has moved the sheet 10 to a position such that a lower edge of the sheet 10 contacts the lower pinch roller 45 and printing of the first color (Y) is completed.

After printing operation of the first color (Y) is completed, the platen driving mechanism 30 is operative to swing the platen roller 21 away from the thermal head 16 and the platen roller 21 is simultaneously rotated clockwise for returning the sheet 10 to a position which the upper edge thereof again contacts the lower pinch roller 45. Then, the ink ribbon 94 is, as depicted in FIG. 24 further extracted from the ink ribbon cartridge 90 to be taken up on the take up reel 17 until the sensors 97, 98 detect via markers (not shown) on the ink ribbon 94, that the ink ribbon is in position for printing the next color (i.e. magenta M). When the ink ribbon has been positioned for printing the next color the above-described steps of FIGS. 21–23 are repeated.

Figure 23:
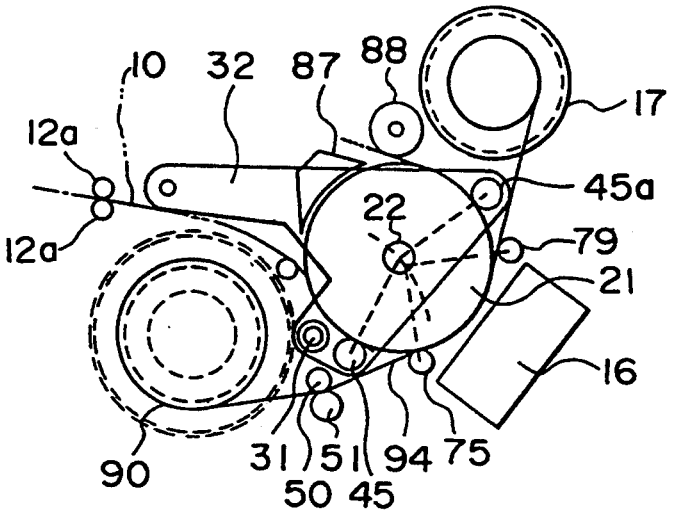
FIG. 23 is a schematic view showing a reverse sheet feeding state of the apparatus of FIG. 1.
Figure 24:
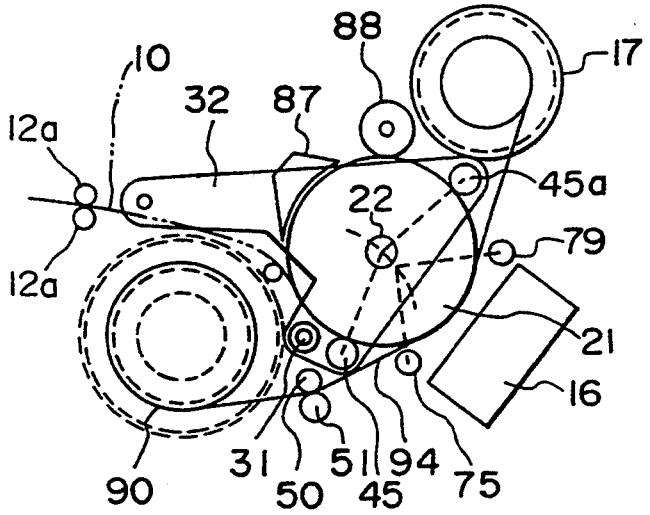
FIG. 24 is a schematic view showing an ink ribbon feeding state of the apparatus of FIG. 1.

Thus is a full color printed image consisting of overlaid images of yellow Y, magenta M and cyan C is to be printed, the operation of FIGS. 21–23 is repeated three times, after which a full color image will have been printed on the sheet 10. Optionally, a black B overlay may also be printed, in which case of course the printing operation must be performed four times and an appropriate (four color block type) ink ribbon must be utilized.

Then, as shown in FIG. 24, after printing of the last color for completing the printed image, as the platen roller 21 is moved away from the thermal head by the upward swinging motion of the platen driving mechanism 30, the platen roller is rotated counterclockwise so as to move the sheet 10 around the platen roller 21 through the upper pinch roller 45*a* to be engaged by a discharge roller 88, in contact with the platen roller 21 to be discharged onto the discharge guide plate 14.

Thus, basically, as shown in the drawings, FIG. 21 represents a paper supply mode, FIG. 22 shows a printing mode, FIG. 23 shows a paper retract mode and FIG. 25 shows a paper discharge mode of the printer of the invention.

Also, during printing operation, as seen in FIG. 18 for example, should a condition arise which causes the ink ribbon 94 to be cut or broken, the break in the ink ribbon 94 is detected by the sensors 97, 98. Upon such detection by the sensors 97, 98, the motor 84 drives the reel mount 69, and thereby the take-up reel 17 in a counterclockwise direction and, the motor 53 is activated for driving the supply reel mount 52 is a clockwise direction and the respective portions of the severed ink ribbon 94 are wound onto the take-up reel 17 or onto the supply reel 93 within the ribbon cartridge 90. At this time the take-up reel 17 may be easily removed from the printer, as described in detail hereinbefore, and then replaced after the broken ink ribbon wound thereon has been removed. Then the old ink ribbon cartridge 90 may be easily removed and a new ink ribbon cartridge 90 loaded in the ink ribbon cartridge receptacle 13 and normal printing operation can be resumed.

Moreover, in a case where the ink ribbon cartridge 90 and the printer 1 function normally with no malfunction, until the ink ribbon 94 in the ink ribbon cartridge 90 is used up, the exhausted ink ribbon 94 wound on the take-up reel 17 may be efficiently rewound back around the supply reel 93 within the ink ribbon cartridge 90 for easy removal. For accomplishing this operation, as seen in FIGS. 10 and 12, the edge portion 80*b* of the ink ribbon guide plate 80 applies pressure to the cylindrical body 17*a* of the take-up reel 17 for applying suitable backtensioning to the ink ribbon 94 such that the ink ribbon 94 may be suitably rewound into the supply reel 93 of the ink ribbon cartridge 90 tightly, without wrinkling according to clockwise rotation of the supply reel 93 via the reel mount 52 by activation of the motor 53. Also, due to the arrangement of the claw portion 18, biased by the coil spring 18*a* mounted in the recess 17*b* of the cylindrical body 17*a* of the take-up reel 17, at a time just before completion of the rewinding operation of the ink ribbon 94, smooth separation of the claw portion 18 and the through hole 95*a* of the pull tab 95 of the ink ribbon 94 is assured. The pull tab is then easily wound back around the platen 21 and between the capstan shaft 50 and the pinch roller 51.

Another structural feature of the present invention is the mounting of the thermal head between the sub-chassis 15 and the main chassis 3. As described hereinbefore, the thermal head 16 is arranged to oppose the platen roller 21 such that the platen driving mechanism 30 may drive the platen roller in and out of contact with the thermal head 16. Since, separation between the thermal head and the platen roller 32 is maintained, this arrangement allows the main chassis 3 to act to dissipate heat generated by the thermal head 16 during printing operations with high heat dissipation characteristics. This makes powered fans, or the like, and driving circuits therefore, as employed in conventional printers unnecessary. Thus, space is conserved and the printer 1 may be made more compact as well as thinner, lighter and easier to transport. Power consumption may also be reduced and manufacturing costs become lower.

Further, reliability of the printer is enhanced by the structure of the platen rotating mechanism 20, working in conjunction with the platen driving mechanism 30 for operating the platen swingably and rotatably to a paper (or other printing material) supply mode, a print mode, a paper retract mode, and a discharge mode. Moreover, the platen rotating mechanism, the platen driving mechanism 30, the ink ribbon guide plates 71, 77, the ink ribbon guide rollers 75, 79 etc., assure clean separation of the ink ribbon 94 and the sheet 10 between printing of each color block and reliable, high quality printing can be achieved.

As mentioned above, since cooling fans, driving circuits therefore and the like are not required in the printer according to the invention, costs are reduced. In addition however, even though the overall size of the printer is reduced, additional space is available within the printer casing 2 for optimizing installation of the thermal head 16, the platen rotating mechanism 20, the platen driving mechanism 30, the platen 21 itself, etc. Thus quality may be improved even while size and costs are reduced.

Moreover, the present invention utilized a single reel type cartridge which further conserves space and simplifies printer operation. As the longitudinal projecting portion 96 is provided with the cut-out portion **96*b* for engaging the lock lever 110 of the ink ribbon cartridge receptacle 90, the ink ribbon cartridge may be secured in operating position easily by an extremely simple mechanism. Also, according to the structure of the invention, the ribbon extracting means, that is, the capstan shaft 50 and the pinch roller 51, also serve to help assure correct positioning of the the ink ribbon cartridge 90**, so space may be conserved and weight reduced.

Also, since the sensor 99 surely detects the marker **95*b* on the pull tab 95 of the ink ribbon 94, misplacement of the ink ribbon in printing operation and malfunction during chucking of the ink ribbon 94** is avoided and printer reliability is improved. It will be noted that, although optical sensors are utilized in the preferred embodiment of a printer according to the invention, magnetic sensors, or other suitable sensing means may alternatively be employed.

Also, while the preferred embodiment of the invention is drawn to a color video printer, the invention may be applied to any type of multi-pass printer requiring aligned overprinting on a single sheet of printing material and requiring a paper supply mode, a printing mode a paper retract mode and a paper discharge mode.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodies without departing from the principle of the invention as set forth in the appended claims.

What is claimed is:

1. A printer comprising:

a housing;

a chassis forming a base for said housing;

a thermal head fixedly mounted in said housing;

a platen roller rotatably supported in said chassis and movable relative to said thermal head;

first platen driving means for swingably moving said platen between a plurality of orientations relative to said thermal head;

second platen driving means for driving said platen to rotate in clockwise and counterclockwise directions in association with movement of said first platen driving means;

a receptacle for receiving an ink ribbon cartridge containing an ink ribbon;

extracting means for extracting the ink ribbon from the ink ribbon cartridge;

ink ribbon guide means guiding the ink ribbon extracted by said extracting means around said platen so as to extend between said platen and said thermal head;

take-up means for retaining the ink ribbon which is extracted from said ink ribbon cartridge;

control means for controlling operation of said first and second platen driving means, said ink ribbon guide means and said take-up means for effecting printing operation on a sheet of printing medium such that aligned overprinting is accomplished on the sheet of printing medium according to movement of the sheet of printing medium via said first platen driving means in conjunction with rotation by said second platen driving means, the aligned overprinting comprising at least a first printing operation corresponding to one extracted position of the ink ribbon from the ink ribbon cartridge and a second printing operation on the sheet of printing medium in alignment with the first printing operation and corresponding to another extracted position of the ink ribbon from the ink ribbon cartridge, said first platen driving means effecting separation between the sheet of printing medium and said thermal head between the first and the second printing operations; and break sensing means for detecting a breakage of the ink ribbon and for generating a signal indicative thereof to said control means, said control means being responsive to said signal so as to activate rewinding means, operatively engaged with a supply reel of the ink ribbon cartridge, and said take-up means so as to wind respective portions of the broken ink ribbon thereon.

2. A printer as set forth in claim 1, further including locking means associated with said receptacle for retaining the ink ribbon cartridge.

3. A printer as set forth in claim 1, wherein a portion of said extracting means acts so as to retain the ink ribbon cartridge in an operational position.

4. A printer as set forth in claim 1, wherein a sub-chassis is further mounted within said housing, said thermal head being mounted on said sub-chassis and said first and second platen driving means being mounted on said chassis.

5. A printer as set forth in claim 1, further including chucking sensing means detecting a leading edge of said ink ribbon for indicating correct chucking operation of the ink ribbon to said control means.

6. A printer as set forth in claim 5, wherein said chucking sensing means comprises an optical sensor.

7. A printer as set forth in claim 5, wherein said chucking sensing means comprising a magnetic sensor

8. A printer as set forth in claim 1, wherein said break sensing means comprises an optical sensor.

9. A printer as set forth in claim 1, wherein said break sensing means comprises a magnetic sensor.

10. A printer as set forth in claim 1, wherein said take-up means includes a take-up reel.

11. A printer as set forth in claim 10, wherein said take-up reel is selectively removable from said housing.

12. A printer as set forth in claim 1, wherein the aligned overprinting comprises three printing operations on the sheet of printing medium corresponding to extracted positions of the ink ribbon having yellow, magenta and cyan color blocks thereof respectively.

13. A printer as set forth in claim 1, wherein the aligned overprinting comprises four printing operations on the sheet of printing medium corresponding to extracted positions of the ink ribbon having yellow, magenta, cyan and black color blocks thereof respectively.

* * * * *